US008678865B2

(12) United States Patent
Hiraishi

(10) Patent No.: US 8,678,865 B2
(45) Date of Patent: Mar. 25, 2014

(54) CONNECTOR WITH RETAINER

(75) Inventor: Takumi Hiraishi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 60 days.

(21) Appl. No.: 13/435,058

(22) Filed: Mar. 30, 2012

(65) Prior Publication Data

US 2012/0252280 A1 Oct. 4, 2012

(30) Foreign Application Priority Data

Mar. 31, 2011 (JP) ..... 2011-079657

(51) Int. Cl.
*H01R 13/514* (2006.01)

(52) U.S. Cl.
USPC ..... 439/752; 439/595

(58) Field of Classification Search
USPC ..... 439/304, 352, 595, 660, 725, 752
See application file for complete search history.

(56) References Cited

U.S. PATENT DOCUMENTS 5,059,142 A * 10/1991 Ohta et al. ..... 439/752
5,183,418 A * 2/1993 Yamanashi et al. ..... 439/752
5,806,152 A * 9/1998 Saitou et al. ..... 24/662
5,931,707 A * 8/1999 Ito ..... 439/752
6,439,915 B2 * 8/2002 Kurimoto ..... 439/352
7,014,511 B2 3/2006 Sagawa et al.
7,112,104 B2 * 9/2006 Sagawa et al. ..... 439/752
7,114,997 B2 * 10/2006 Sagawa et al. ..... 439/752
7,476,133 B2 * 1/2009 Tanaka et al. ..... 439/752
7,488,221 B2 * 2/2009 Tanaka et al. ..... 439/752
2002/0168895 A1 11/2002 Suzuki
2003/0027456 A1 2/2003 Yamawaki et al.
2005/0090148 A1 4/2005 Sagawa et al.
2008/0280489 A1 11/2008 Tanaka et al.

FOREIGN PATENT DOCUMENTS

EP 1873868 A1 10/2008

* cited by examiner

*Primary Examiner* — Thanh Tam Le
(74) *Attorney, Agent, or Firm* — Gerald E. Hespos; Michael J. Porco; Matthew T. Hespos

(57) ABSTRACT

Two partial locks (34) formed on opposite ends of a retainer (30) in a width direction are engaged with a housing (10) to prevent the retainer (30) at a partial locking position from being displaced in a direction opposite to a direction toward a full locking position. The retainer (30) also has a resilient restricting portion (43) between the partial locks (34) in the width direction to engage the housing (10) when the retainer (30) is at the partial locking position and to prevent the retainer (30) from being curved and deformed to bulge out in the direction opposite to the direction toward the full locking position by being.

8 Claims, 10 Drawing Sheets

CONNECTOR WITH RETAINER

BACKGROUND OF THE INVENTION

1. Field of the Invention

The invention relates to a connector.

2. Description of the Related Art

U.S. Pat. No. 7,014,511 discloses a connector including a housing into which terminal fittings are to be inserted, and a retainer to be mounted into the housing from the front. The retainer is movable between a partial locking position and a full locking position which is located behind the partial locking position. The terminal fittings can be inserted into the housing and withdrawn from the housing when the retainer is at the partial locking position. However, the retainer at the full locking position retains the previously inserted terminal fittings in the housing. Two partial locking projections are arranged on opposite ends of the retainer in a width direction that intersects the inserting and withdrawing directions. The partial locking projections engaged the housing when the retainer is at the partial locking position to prevent the retainer from coming out forward. Full locking projections also are formed on the retainer and engage the housing when the retainer is at the full locking position to prevent a movement of the retainer toward the partial locking position.

A laterally central part of the retainer is pushed from behind to disengage the full locking projections so that the retainer of the above-described connector can be moved from the full locking position to the partial locking position. A pushing force to move the retainer from the full locking position to the partial locking position is large and exceeds a locking force of the full locking projections. This pushing force is likely to continue when the retainer reaches the partial locking position with the partial locking projections on the opposite widthwise ends engaging the housing. This excessive force may curve and deform the retainer. The partial locking projections on the widthwise ends of the curved and deformed retainer assume oblique alignments and could disengage from the housing. As a result, the retainer may come out forward from the housing.

The invention was completed in view of the above situation and an object thereof is to reliably position a retainer.

SUMMARY OF THE INVENTION

The invention relates to a connector with a housing and a retainer mounted in the housing. The housing is configured so that at least one terminal fitting can be inserted therein. The retainer is movable in the housing between a first or partial locking position where the insertion of the terminal fitting is permitted and a second or full locking position where the already inserted terminal fitting is retained. One or more partial locks are formed on the retainer and engage the housing to prevent the retainer at the first position from being displaced in a direction opposite to a direction toward the second position. An operating portion is formed on the retainer and is configured to transmit a force to displace the retainer from the second position toward the first position. The retainer is formed with at least one resilient restricting portion that engages the housing when the retainer is at the first position to prevent the retainer from being curved and deformed to bulge out in a direction opposite to the direction toward the second position.

The retainer preferably has a partial lock on each of the opposite ends in a width direction intersecting a mounting direction into the housing.

The operating portion preferably is at a substantially central position in the width direction.

The resilient restricting portion preferably is between the two partial locks in the width direction.

The operating portion is pushed to move the retainer from the full locking position to the partial locking position. The partial locks on the opposite widthwise ends of the retainer engage the housing to prevent further movement of the retainer when the retainer reaches the partial locking position. At this time, the resilient restricting portion, which is between the partial locks in the width direction, engages the housing to prevent a curved deformation of the retainer. Accordingly, the partial locks will not disengage from the housing due to a curved deformation of the retainer and the retainer reliably stops at the partial locking position.

The retainer preferably has at least one auxiliary lock that engages the housing when the retainer is pushed to the first position to prevent the retainer from being curved and deformed to bulge out in the direction opposite the direction toward the second position. The auxiliary lock may be between the partial lock and the resilient restricting portion in the width direction.

The retainer preferably has at least guide that can fit into at least one guide groove in the housing so that the posture of the retainer with respect to the housing can be stabilized in the vertical direction and/or the width direction.

The retainer preferably has an auxiliary lock that can engage a mating lock on the housing to position the retainer at the first position and/or at the second position.

These and other objects, features and advantages of the invention will become more apparent upon reading the following detailed description of preferred embodiments and accompanying drawings. Even though embodiments are described separately, single features may be combined to additional embodiments.

DETAILED DESCRIPTION OF THE PREFERRED EMBODIMENTS

Figure 1:
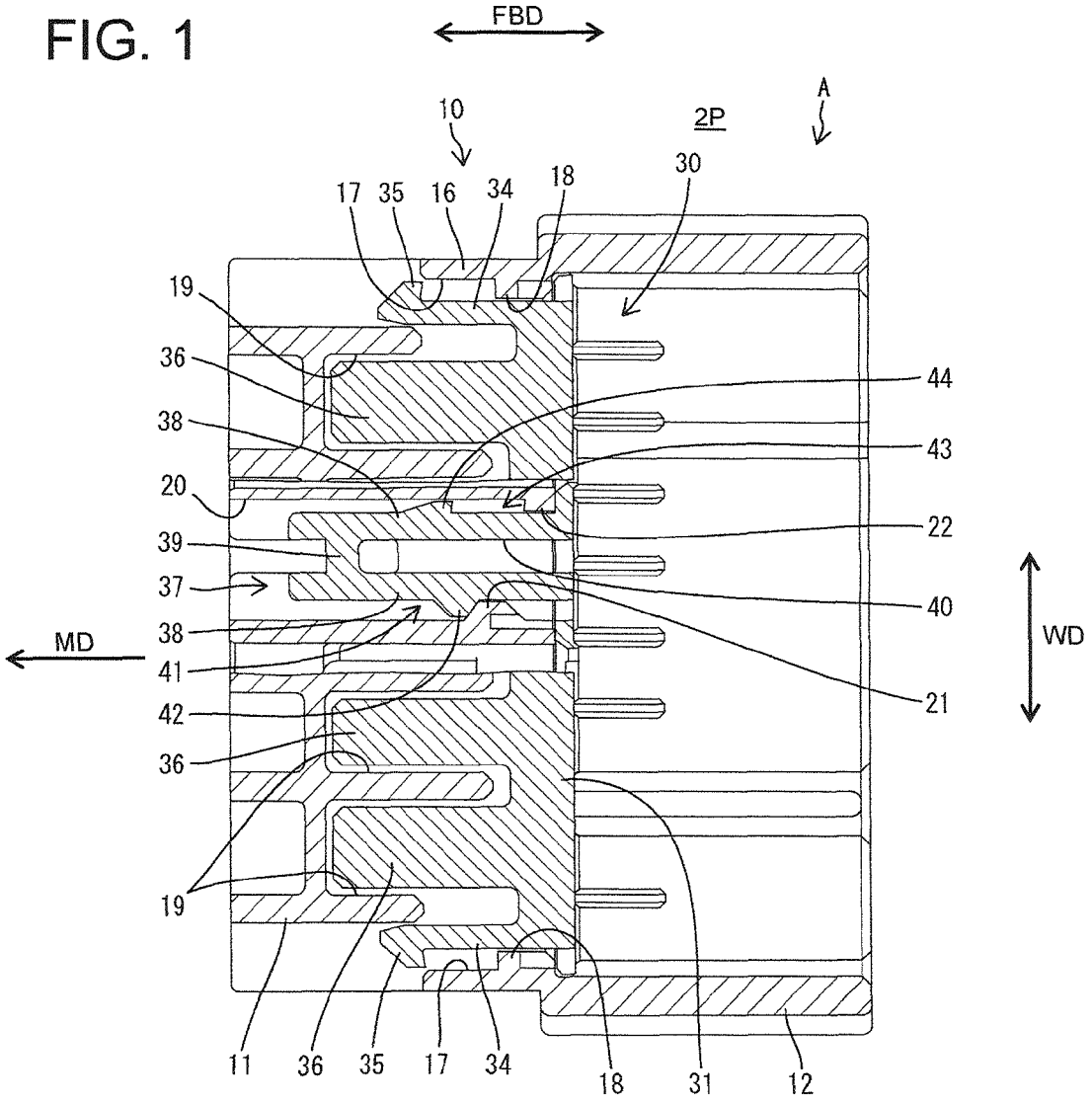
FIG. 1 is a horizontal section showing a state where a retainer is at a full locking position in a first embodiment.
Figure 2:
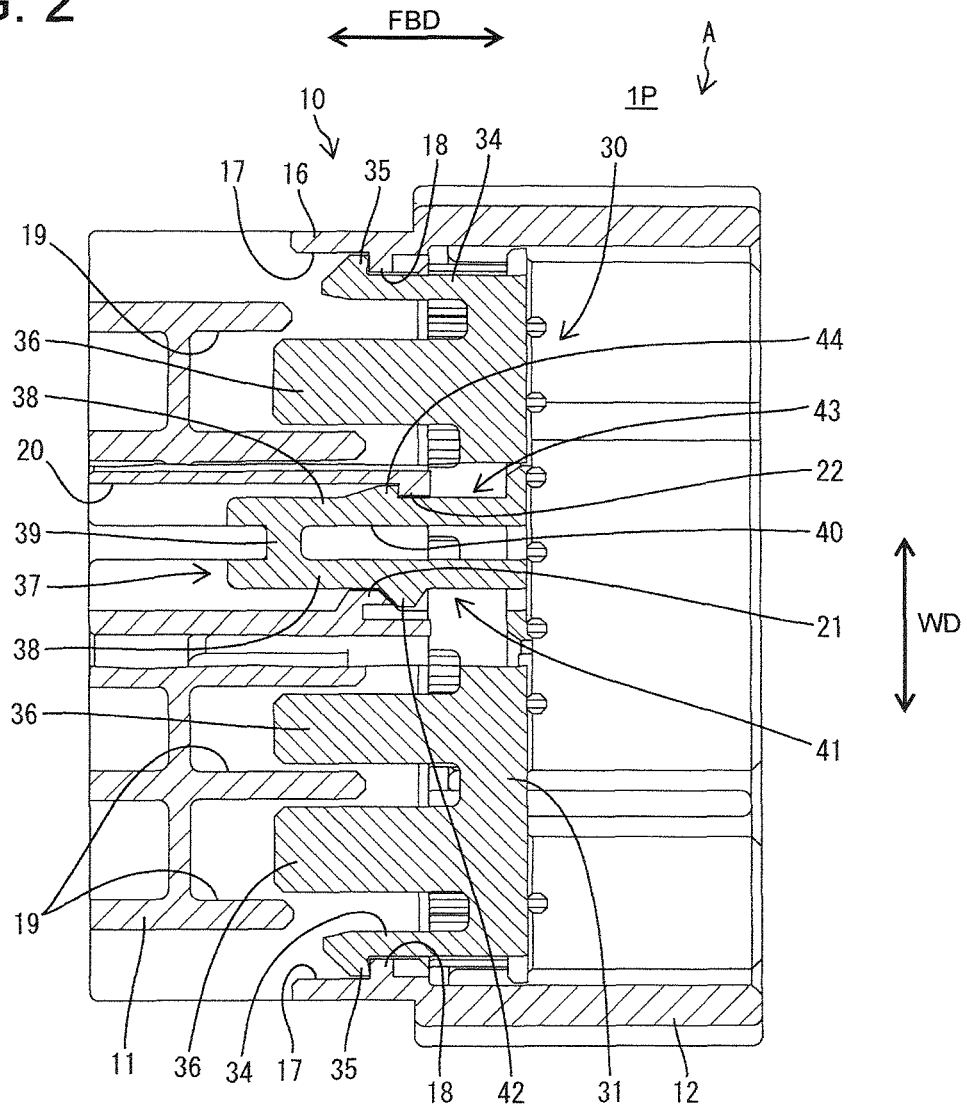
FIG. 2 is a horizontal section showing the retainer at a partial locking position.

A first embodiment of the invention is described with reference to FIGS. 1 to 7. As shown in FIGS. 1 and 2, a connector A of this embodiment has a housing 10 made of synthetic resin, terminal fittings 25 and a retainer 30 made of synthetic resin. FIGS. 1 and 2 are sections cut along line X-X of FIG. 5, which is a front view of the retainer 30 alone. The line X-X is bent in a step-like manner and is composed of lines cutting guides 36 and a line cutting an operating portion 37 arranged at a position higher than the guides 36.

Figure 3:
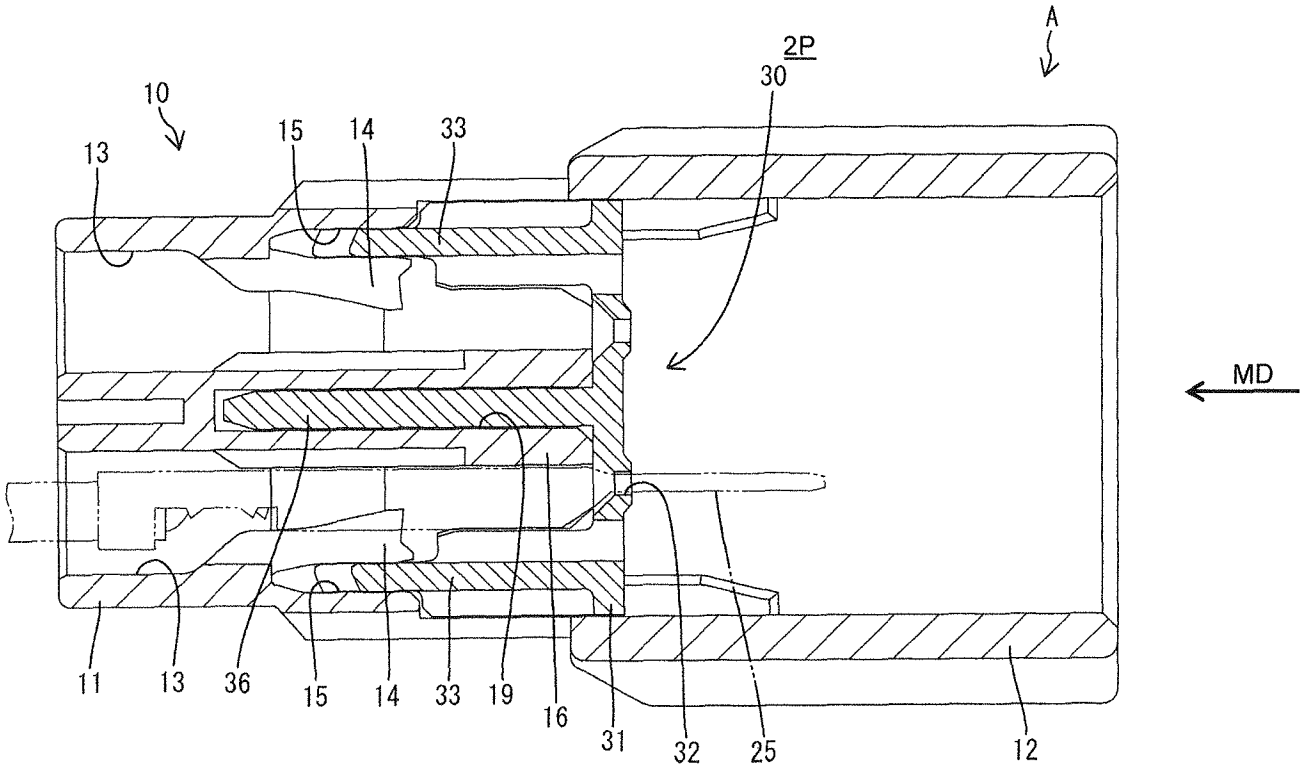
FIG. 3 is a vertical section showing the retainer at the full locking position.
Figure 4:
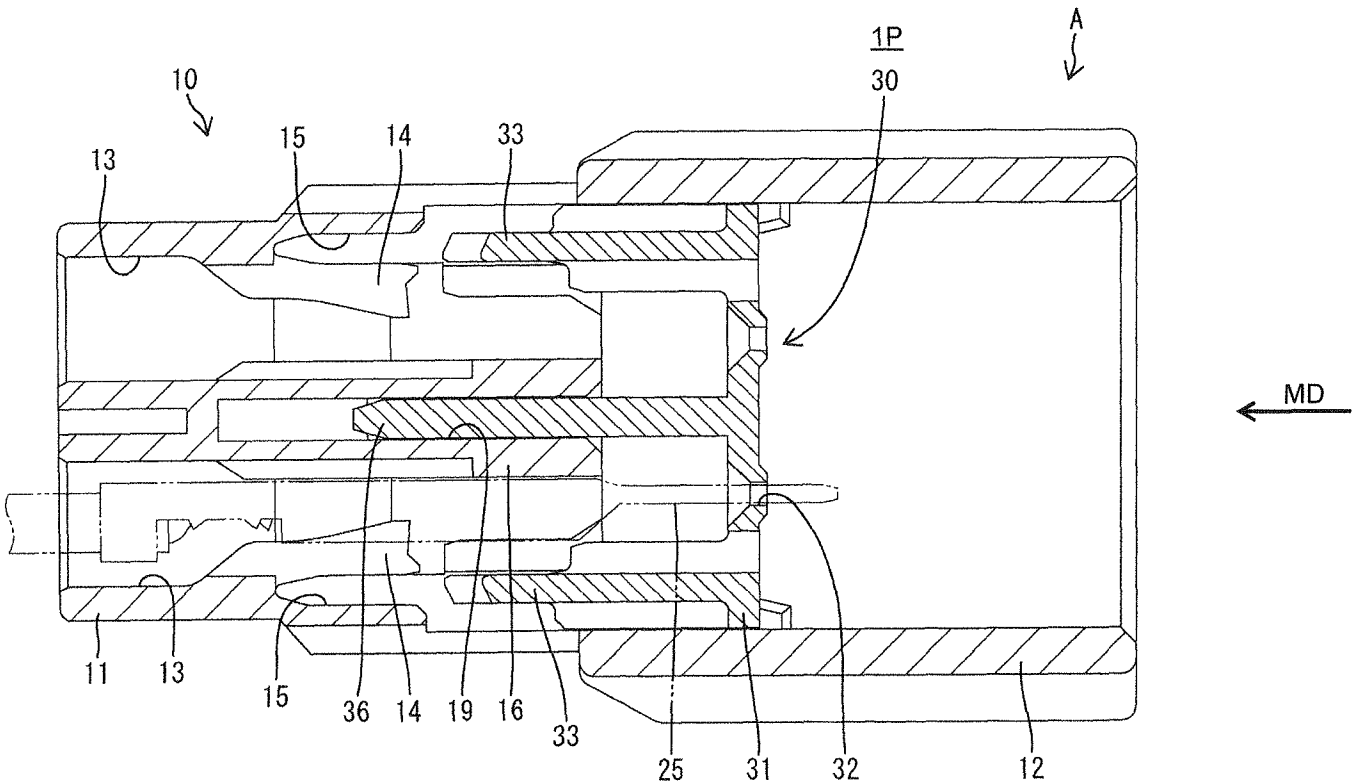
FIG. 4 is a vertical section showing the retainer at the partial locking position.

As shown in FIGS. 3 and 4, the housing 10 includes a terminal accommodating portion 11 and a receptacle 12 extending forward (right in FIGS. 1 to 4) from the outer peripheral edge of the front end of the terminal accommodating portion 11. Terminal accommodating chambers 13 penetrate the terminal accommodating portion 11 in forward and backward directions and are formed side by side in a lateral direction at upper and lower levels. A locking lance 14 is cantilevered forward along an upper wall portion of each terminal accommodating chamber 13 in the upper level and a locking lance 14 is cantilevered forward along a lower wall in each terminal accommodating chamber 13 in the lower level. Deformation spaces 15 communicate with front ends of the terminal accommodating chambers 13 and the interior of the receptacle 12 for permitting resilient deformations of the locking lances 14.

The terminal fitting 25 is a male terminal having a tab at the leading end and is inserted into the terminal accommodating chamber 13 from behind, as shown in FIGS. 3 and 4. A front portion of the terminal fitting 25 interferes with the locking lance 14 while inserting the terminal fitting 25 and deforms the locking lance 14 into the deformation space 15. The locking lance 14 resiliently restores and retracts from the deformation space 15 to engage the terminal fitting 25 when the terminal fitting 25 reaches a proper insertion position. Thus, the locking lance 14 engages and retains the terminal fitting 25. It should be understood that the invention also is applicable to female terminal fittings.

The terminal accommodating portion 11 has a partition wall 16 that partitions between the terminal accommodating chambers 13 in the upper level and those in the lower level, as shown in FIGS. 3 and 4. Substantially bilaterally symmetrical locking spaces 17 penetrate the terminal accommodating portion 11 in forward and backward directions, as shown in FIGS. 1 and 2. Front end openings of the locking spaces 17 are formed at opposite ends of the partition wall 16 in the width direction WD and face the interior of the receptacle 12. The right locking space 17 is formed with a first stopper 18 projecting from the right inner surface and the left locking space 17 is formed with a first stopper 18 projecting from the left inner surface. The first stoppers 18 have each a locking surface substantially perpendicular to forward and backward directions FBD and facing backward.

The partition wall 16 has guide grooves 19 in the form of slits that are long and narrow in a horizontal width direction WD, as shown in FIGS. 1 and 2. The guide grooves 19 are arranged side by side in the width direction WD in the front surface of the terminal accommodating portion 11 (back end of the receptacle 12). The two guide grooves 19 on the opposite ends in the width direction WD communicate with the locking spaces 17.

An operation space 20 penetrates the terminal accommodating portion 11 in forward and backward directions FBD and has a front end opening that faces the interior of the receptacle 12, as shown in FIGS. 1 and 2. The operation space 20 is a slit that is long and narrow in the horizontal direction and is at a substantially central position of the housing 10 in the width direction WD. The operation space 20 is at substantially the same height as the terminal accommodating chambers 13 in the upper level and is above the guide grooves 19 in the vertical direction.

A substantially trapezoidal second stopper 21 projects from one of left and right inner surfaces of the operation space 20. The front and rear surfaces of the second stopper 21 are semi-locking surfaces that incline with respect to the moving directions MD of the retainer 30. Further, a third stopper 22 projects from the other of the left and right inner surfaces of the operation space 20. The third stopper 22 has a locking surface substantially perpendicular to the moving directions MD of the retainer 30 and facing substantially backward similar to the first stoppers 18.

Figure 5:
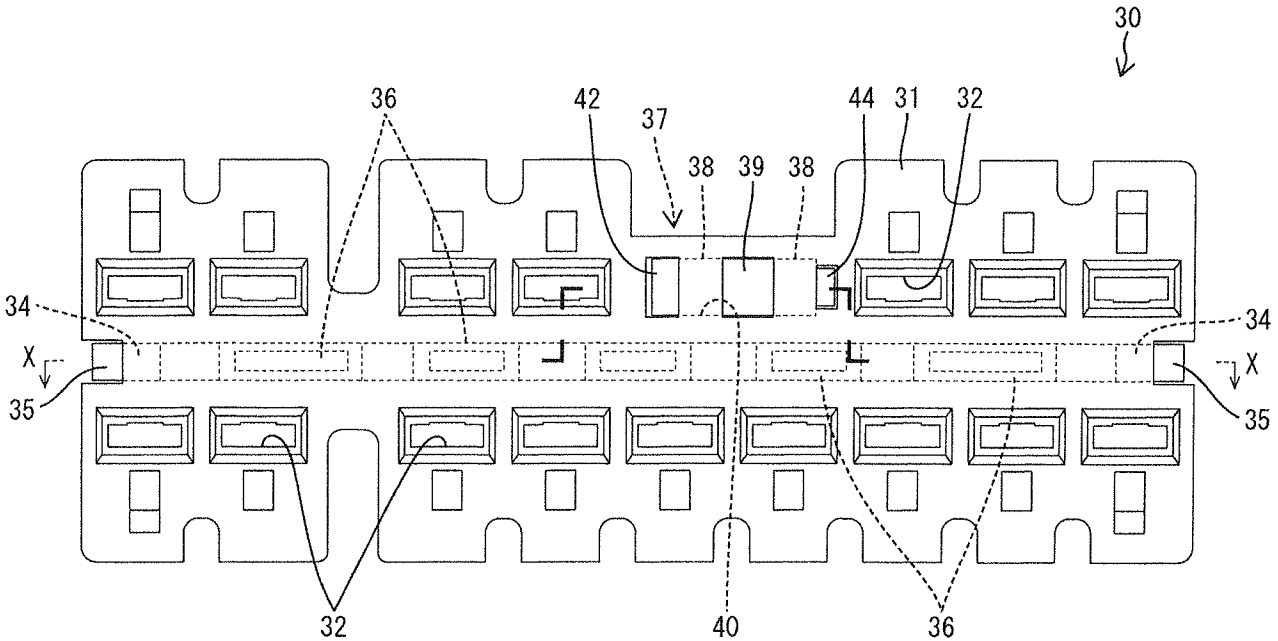
FIG. 5 is a front view of the retainer.
Figure 6:
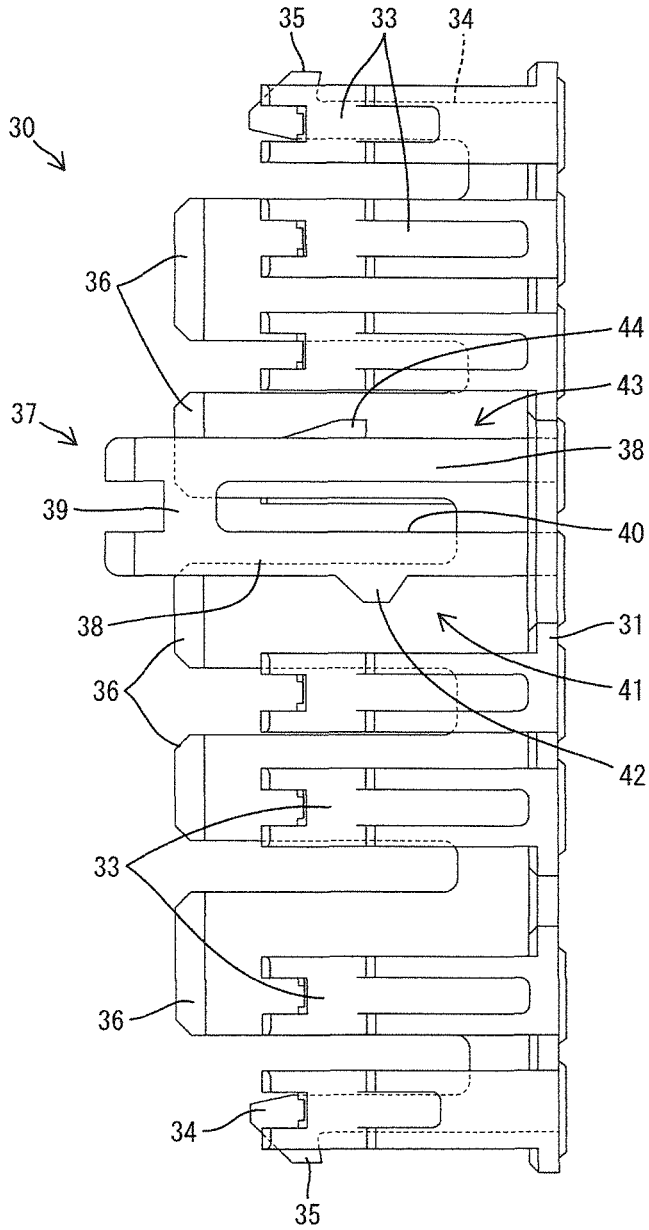
FIG. 6 is a plan view of the retainer.
Figure 7:
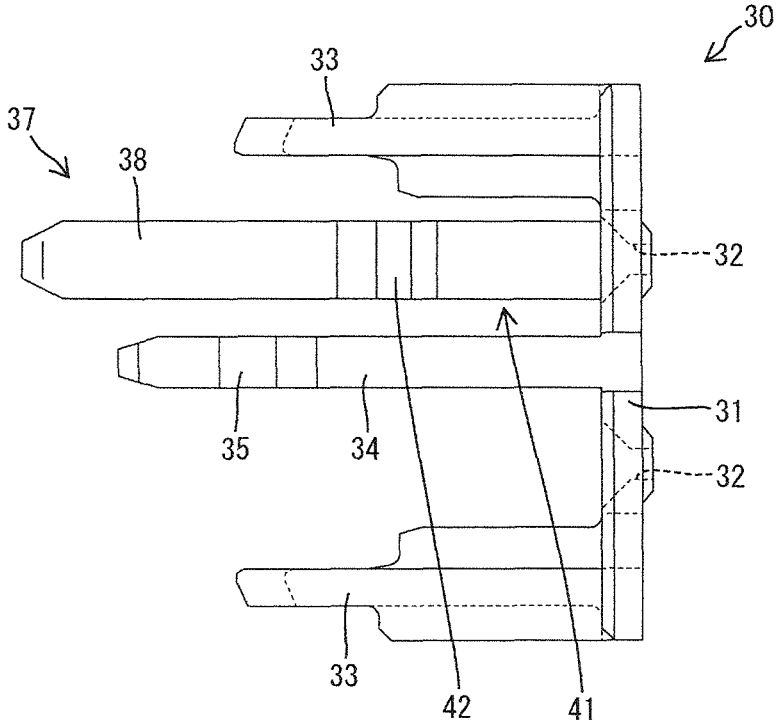
FIG. 7 is a side view of the retainer.

As shown in FIGS. 5 to 7, the retainer 30 includes a substantially rectangular front wall 31 corresponding to the front of the terminal accommodating portion 11.

As shown in FIGS. 4, 5 and 7, tab insertion holes 32 penetrate through the front wall 31 at positions corresponding to the respective terminal accommodating chambers 13. Retaining portions 33 are cantilevered from an upper part of the front wall 31 and are insertable into the deformation spaces 15 in the upper level. Similarly, retaining portions 33 are cantilevered from a lower part of the front wall 31 and are insertable into the deformation spaces 15 in the lower level.

Two bilaterally symmetrical partial locks 34 are cantilevered back from a central height of the front wall 31 in the vertical direction and at opposite left and right sides of the front wall 31 in the width direction WD. A locking projection 35 is formed near an extending rear end of each partial lock 34 and projects out in the width direction WD. The locking projection 35 has a forwardly facing locking surface aligned substantially perpendicular to the moving directions MD of the retainer 30 from the full locking position 2P toward the partial locking position 1P. The partial locks 34 are insertable into the locking spaces 17.

Guides 36 are cantilevered back from the front wall and define substantially horizontal plates. The guides 36 are arranged substantially at an intermediate height of the front wall 31 in the vertical direction and are juxtaposed in a row in the width direction WD. The guide portions 36 are insertable into the respective guide grooves 19.

The operating portion 37 is cantilevered rearward from a position on the front wall 31 at substantially the same height as the tab insertion holes 32 in the vertical direction and at an intermediate position of the retainer 30 in the width direction WD. The operating portion 37 includes substantially parallel first and second resilient arms 38 that extend back from the front wall 31, and a coupling 39 that couples the rear extending ends of the resilient arms 38. Thus the resilient arms 38 are supported on both ends. Further, a deformation permitting space 40 is defined between the resilient arms 38.

A substantially trapezoidal common projection 42 projects from the outer side surface of the first resilient arm 38 of the operating portion 37. Front and rear surfaces of the common projection 42 define semi-locking surfaces that are inclined with respect to the moving directions MD of the retainer 30. The common projection 42 and the first resilient arm 38 define a common lock 41 that is supported on both front and rear ends and is sufficiently resiliently deformable so that the common projection 42 is displaced in the width direction WD as the resilient portion 38 enters the deformation permitting space 40.

A restricting projection 44 projects in the width direction WD from the outer side surface of the second resilient arm 38 and is at an intermediate position of the second resilient arm 38 in forward and backward directions FBD. The restricting projection 44 and the second resilient arm 38 define a resilient restricting portion 43. Thus, the resilient restricting portion 43 of the operating portion 37 is supported on both front and rear ends and is sufficiently resiliently deformable that the resilient enters 38 enters the deformation permitting space 40 and the restricting projection 44 is displaced in the width direction WD.

The retainer 30 is mounted into the terminal accommodating portion 11 from the front. In mounting the retainer 30, the guides 36 fit into the guide grooves 19 to stabilize the posture of the retainer 30 with respect to the terminal accommodating portion 11 in the vertical direction and width direction WD. The left and right locking projections 35 interfere with the first stoppers 18 in the process of mounting the retainer 30. As a result, the partial locks 34 resiliently displace inward in the width direction WD. Substantially simultaneously, the restricting projection 44 interferes with the third stopper 22 and causes the resilient restricting portion 43 to displace resiliently in the width direction WD.

The common lock 41 contacts the second stopper 21 from the front when the retainer 30 reaches the partial locking position 1P, as shown in FIG. 2, to prevent any further mounting movement of the retainer 30. Further, the partial locks 34 restore resiliently so that the locking projections 35 engage the first stoppers 18 from behind. Simultaneously, the resilient restricting portion 43 restores resiliently and the restricting projection 44 engages the third stopper 22 from behind. These engagements prevent a forward displacement of the retainer 30 away from the terminal accommodating chambers 13 and hence hold the retainer 30 at the partial locking position 1P.

The rear extending ends of the retaining portions 33 are retracted forward from the front extending ends of the locking lances 14 with the retainer 30 at the partial locking position 1P, as shown in FIG. 4. Therefore the locking lances 14 can deform resiliently toward the deformation spaces 15 and the terminal fittings 25 can be inserted into the terminal accommodating chambers 13 with the retainer 30 at the partial locking position 1P.

The front wall 31 of the retainer 30 is pushed from the front and in the moving direction MD after all of the terminal fittings 25 are inserted, thereby displacing the retainer from the partial locking position 1P to the full locking position 2P. The common projection 42 interferes with the second stopper 21 in the process of displacing the retainer 30 from the partial locking position 1P to the full locking position 2P. As a result, the common lock 41 resiliently deforms in the width direction WD and enters the deformation permitting space 40. At this time, the semi-locking surfaces of the common projection 42 and the second stopper 21 slide in contact in a direction oblique to the moving direction MD of the retainer 30 so that the common lock 41 deforms smoothly.

The front wall 31 contacts the front end surface of the terminal accommodating portion 11 when the retainer 30 reaches the full locking position 2P, as shown in FIG. 3, thereby preventing any further pushing movement of the retainer 30. Further, the common lock 41 resiliently restores, as shown in FIG. 1, so that the common projection 42 engages the second stopper 21 from behind to prevent a forward movement of the retainer 30 toward the partial locking position 1P and to hold the retainer 30 at the full locking position 2P. The retaining portions 33 are in the deformation spaces 15 when the retainer 30 is at the full locking position 2P, as shown in FIG. 3. Thus, the locking lances 14 cannot displace away from the terminal fittings 25 and toward the deformation spaces 15, thereby reliably retaining the terminal fittings 25.

A jig or the like may be inserted into the operation space 20 from behind to push the operating portion 37 from behind if the retainer 30 is to be moved from the full locking position 2P to the partial locking position 1P. Thus, the common projection 42 slides in contact with the second stopper 21 and the common lock 41 resiliently deforms to enter the deformation permitting space 40. The locking projections 35 of the partial locks 34 engage the first stoppers 18 on opposite widthwise ends of the retainer 30, as shown in FIG. 2, when the retainer 30 reaches the partial locking position 1P. As a result, the retainer 30 stops at the partial locking position 1P.

The two partial locks 34 are arranged on the opposite widthwise ends of the retainer 30 and the operating portion 37 is arranged in a widthwise intermediate part. Thus, the retainer 30 may be curved and deformed to bulge out forward if a pushing force given to the retainer 30 is excessive. Such a curvature deformation could cause the partial locks 34 to extend in oblique directions and could displace the locking projections 35 in directions away from the first stoppers 18. In this case, the locking projections 35 and the first stoppers 18 could disengage so that the retainer 30 passes the partial locking position and moves forward from the terminal accommodating portion 11.

However, the resilient restricting portion 43 is formed in the center of the retainer 30 in the width direction WD and midway between partial locking portions 34. The resilient restricting portion 43 engages the housing 10 when the retainer 30 is at the partial locking position 1P and prevents the retainer 30 from being curved and deformed to bulge out in the direction opposite to the direction toward the full locking position 2P. Thus, the partial locks 34 will not disengage from the housing 10 due to a curved deformation of the retainer 30, and the retainer 30 is stopped reliably at the partial locking position 1P.

Figure 8:
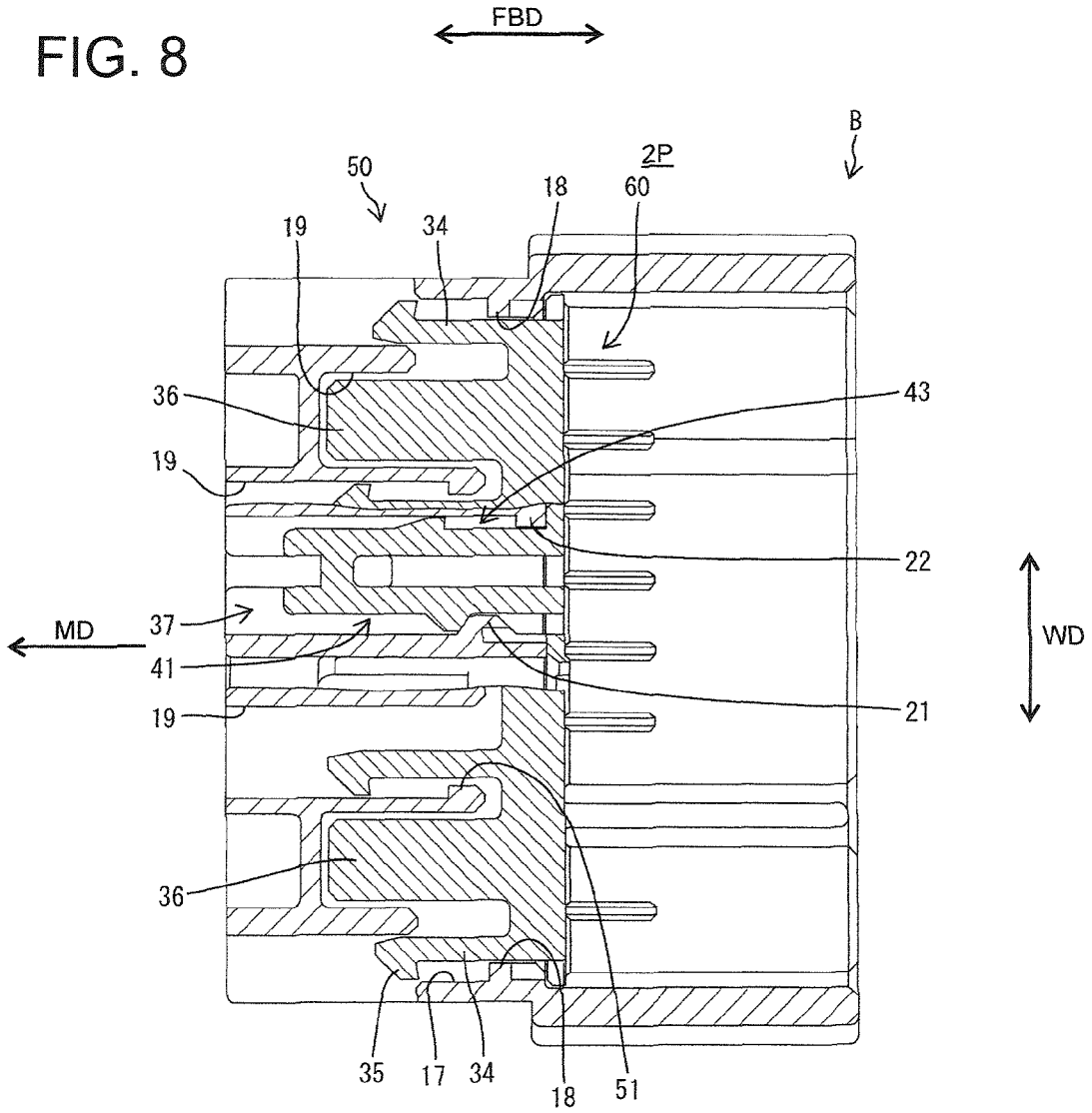
FIG. 8 is a horizontal section showing a retainer at a full locking position in a second embodiment.
Figure 9:
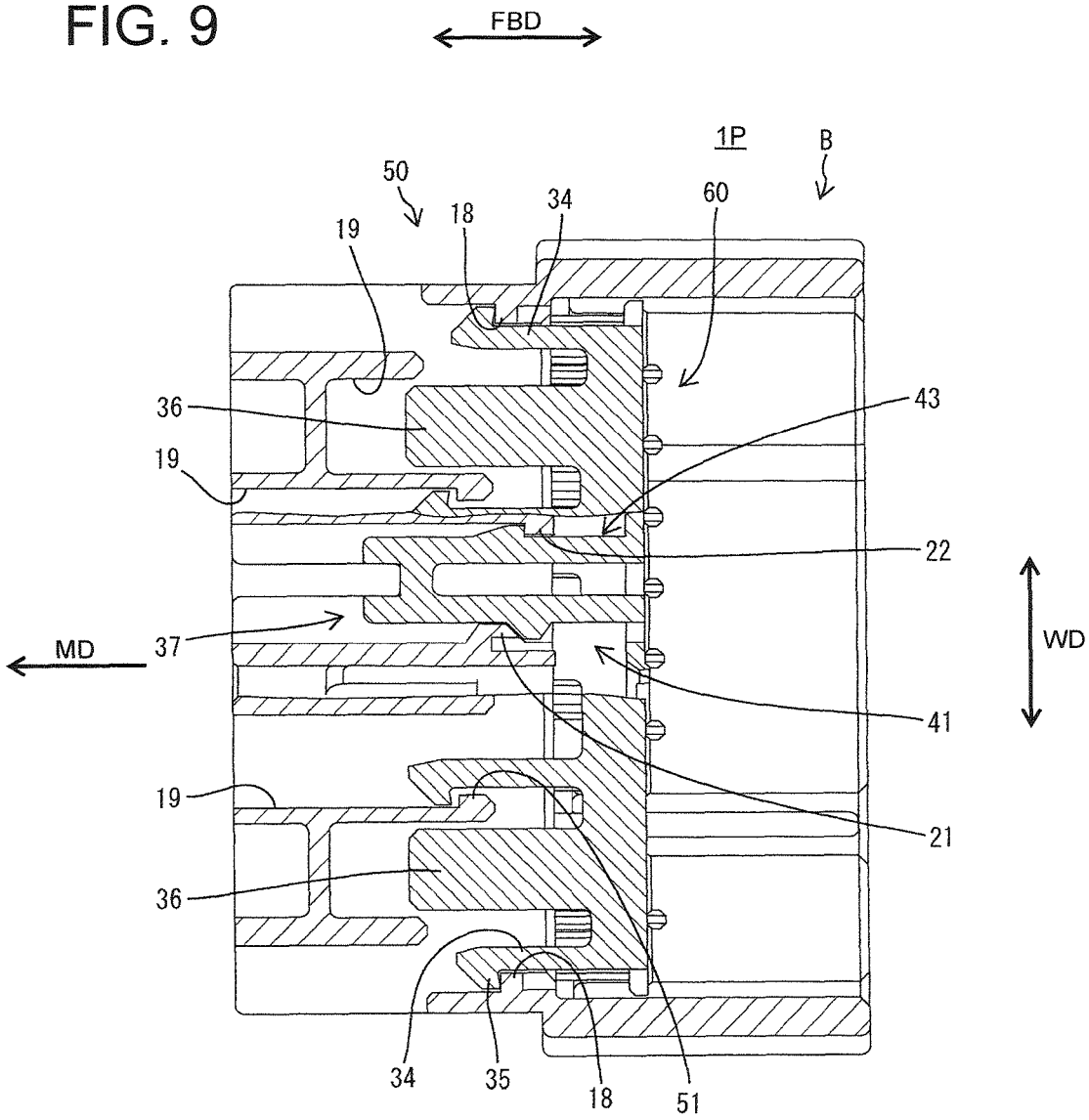
FIG. 9 is a horizontal section showing the retainer at a partial locking position.
Figure 10:
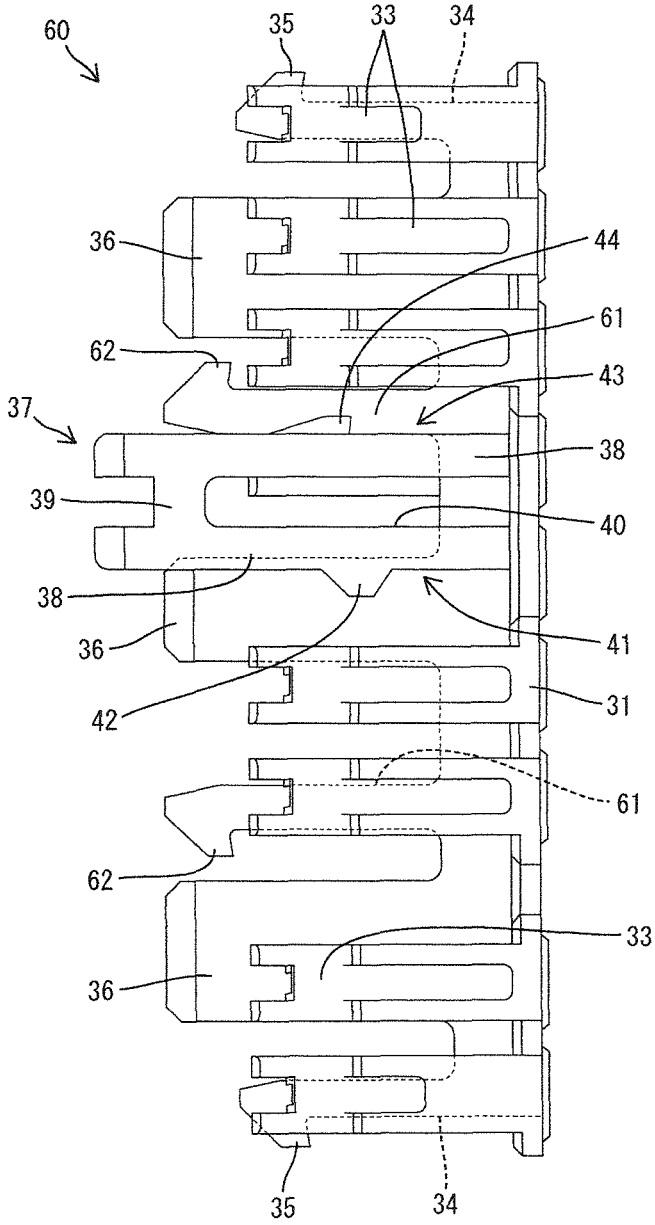
FIG. 10 is a plan view of the retainer.

A second specific embodiment of the invention is described with reference to FIGS. 8 to 10. A connector B of this second embodiment differs from the first embodiment in a part of a housing 50 and a part of a retainer 60. Other constructions that are similar to or the same as in the first embodiment are identified by the same reference numerals but are not described again.

The housing 50 of the second embodiment includes fourth stoppers 51 projecting from the inner side surfaces of two guide grooves 19. Similar to first stoppers 18 and a third stopper 22, the fourth stoppers 51 have a locking surface substantially perpendicular to moving directions MD of the retainer 60 and facing backward.

The retainer 60 of the second embodiment includes a front wall 31 having substantially the same shape as the retainer 30 of the first embodiment. Sections of FIGS. 8 and 9 are those cut along the same line (not shown) as the line X-X of FIG. 5 in the front surface of the front wall 31. The retainer 60 is formed by eliminating two guides 36 in the retainer 30 of the first embodiment and forming left and right auxiliary locks 61 at positions where the guides 36 had been. Each auxiliary lock 61 is cantilevered back from the front wall 31. The auxiliary locks 61 are at the same height as guide grooves 19 in the vertical direction and are disposed respectively between a right partial lock 34 and a resilient restricting portion 43 and between a left partial lock 34 and the resilient restricting portion 43 in the width direction WD. Auxiliary projections 62 are formed on the extending rear ends of the auxiliary locks 61 and project outward in the width direction WD. Each auxiliary projection 62 has a locking surface substantially perpendicular to the moving directions MD of the retainer 60 and facing forward in the moving direction of the retainer 60 from a full locking position 2P toward a partial locking position 1P. The auxiliary locks 61 are insertable into the guide grooves 19 where the fourth stoppers 51 are formed.

The retainer 60 at the full locking position 2P can be moved forward to the partial locking position 1P by pushing an operating portion 37. The partial locks 34 on the opposite widthwise ends engaged with the first stoppers 18, as shown in FIG. 9, to stop the movement of the retainer 60 at the partial locking position 1P. At this time, the resilient restricting portion 43 at the intermediate position in the width direction WD engages the third stopper 22 and the two auxiliary locks 61 arranged between the partial locks 34 and the resilient restricting portion 43 in the width direction WD engage the fourth stoppers 51. These engagements prevent a curved deformation of the retainer 60 and reliably stop the retainer 60 at the partial locking position.

The invention is not limited to the above described embodiments. For example, the following embodiments also are included in the scope of the invention.

Although the resilient restricting portion is supported on both ends in the first and second embodiments, the resilient restricting portion may be supported on one end.

One resilient restricting portion is provided in the first and second embodiments. However, plural laterally spaced resilient restricting portions may be provided.

Although the resilient restricting portion is formed on the operating portion in the first and second embodiments, it may be formed on another part.

The resilient restricting portion is displaced in the width direction in the first and second embodiments, but it may be displaced in a different direction.

The resilient restricting portion is resiliently displaced in a direction intersecting the moving directions of the retainer in the first and second embodiments. However, the resilient restricting portion may be fixed without being resiliently displaced. In this case, a lock of the housing to be engaged with the resilient restricting portion may be resiliently displaceable.

Although each partial lock is supported on one end in the first and second embodiments, it may be supported on both ends.

The partial locks are displaced in the width direction in the first and second embodiments, but they may be displaced in a direction intersecting the width direction.

The partial locks are resiliently displaced in directions intersecting the moving directions of the retainer in the first and second embodiments, but they may be fixed without being resiliently displaceable. In this case, locks of the housing to be engaged with the partial locks may be resiliently displaceable.

Each auxiliary lock is supported on one end in the second embodiment, but it may be supported on both ends.

Although two auxiliary locks are provided in the second embodiment, one or three or more auxiliary locking portions may be provided while being spaced apart in the width direction.

Although the auxiliary locks are displaced resiliently in directions intersecting the moving directions of the retainer in the second embodiment, they may be fixed without being resiliently displaced. In this case, locking portions of the housing to be engaged with the auxiliary locks may be resiliently displaceable.

What is claimed is:

1. A connector, comprising:

a housing into which at least one terminal fitting is to be inserted;

a retainer to be mounted into the housing and movable between a first position where the insertion of the terminal fitting is permitted and a second position where the inserted terminal fitting is retained;

first and second partial locks formed on opposite ends of the retainer in a width direction intersecting a mounting direction into the housing, locking projections formed on the first and second partial locks configured to engage the housing and to prevent the retainer at the first position from being displaced in a direction opposite to the mounting direction toward the second position;

an operating portion on the retainer and disposed to transmit a force to displace the retainer from the second position toward the first position; and at least one resilient restricting portion formed on the retainer between the first and second partial locks and engageable with the housing when the retainer is at the first position to prevent the retainer from being curved and deformed to bulge out in the direction opposite to the direction toward the second position.

2. The connector of claim 1, wherein the operating portion is at a substantially central position in the width direction.

3. The connector of claim 1, further comprising at least one auxiliary lock formed on the retainer and engageable with the housing when the retainer is at the first position to prevent the retainer from being curved and deformed to bulge out in the direction opposite to the direction toward the second position.

4. The connector of claim 3, wherein the auxiliary lock is arranged between the partial lock and the resilient restricting portion in the width direction.

5. The connector of claim 1, wherein the retainer is formed with at least guide which can be at least partly fitted into at least one guide groove provided in the housing to stabilize the retainer with respect to the housing in a vertical direction and a width direction.

6. The connector of claim 1, wherein the retainer further comprises an auxiliary lock that can engage a mating lock on the housing to position the retainer at the first position or at the second position.

7. The connector of claim 1, wherein the locking projections are formed on ends of the first and second partial locks.

8. The connector of claim 1, wherein the locking projections are on outwardly facing surfaces of the first and second partial locks.

* * * * *